US005823705A

United States Patent [19]

Jackson et al.

[11] Patent Number: 5,823,705

[45] Date of Patent: Oct. 20, 1998

[54] MULTIPURPOSE ENERGY ABSORBING BARRIER SYSTEM

[75] Inventors: Martin A. Jackson, Warwick, R.I.; John M. Rhatigan, Hudson, Mass.

[73] Assignee: The Entwistle Company, Hudson, Mass.

[21] Appl. No.: 733,523

[22] Filed: Oct. 18, 1996

Related U.S. Application Data

[63] Continuation-in-part of Ser. No. 549,510, Oct. 27, 1995, Pat. No. 5,624,203, and Ser. No. 549,508, Oct. 27, 1995, Pat. No. 5,634,738.

[51] Int. Cl.[6] ..... E01F 13/00

[52] U.S. Cl. ..... 404/6; 49/9

[58] Field of Search ..... 404/6; 49/9, 34, 49/49, 404

[56] References Cited

U.S. PATENT DOCUMENTS

| | | | |
|---|---|---|---|
| 1,748,563 | 2/1930 | Strauss . | |
| 1,929,859 | 10/1933 | Strauss | 49/9 X |
| 2,237,106 | 4/1941 | Minert | 49/9 |
| 2,251,699 | 8/1941 | Bansch Bach | 49/9 |
| 2,324,726 | 7/1943 | Sawyer | 49/9 X |
| 2,336,483 | 12/1943 | Hoover | 49/9 |
| 2,440,574 | 4/1948 | Cotton | 49/9 X |
| 2,450,328 | 2/1948 | Cotton | 49/9 X |
| 2,465,936 | 3/1949 | Schultz | 244/110 |
| 2,675,197 | 4/1954 | Hospers | 244/110 R |
| 2,979,163 | 4/1961 | Van Zelm et al. | 188/1 |
| 2,980,213 | 4/1961 | Van Zelm et al. | 188/1 |
| 3,017,163 | 1/1962 | Van Zelm et al. | 258/1.2 |
| 3,211,260 | 10/1965 | Jackson | 188/1 |
| 3,366,353 | 1/1968 | Jackson | 244/137 |
| 3,887,909 | 6/1975 | Eiku | 340/548 X |
| 4,829,287 | 5/1989 | Karr et al. | 340/548 X |
| 5,118,056 | 6/1992 | Jeanise | 49/9 |
| 5,500,642 | 3/1996 | Battle | 300/436 X |

*Primary Examiner*—Tamara L. Graysay
*Assistant Examiner*—Frederick L. Lagman
*Attorney, Agent, or Firm*—Jacob N. Erlich; Jerry Cohen

[57] ABSTRACT

A restraining barrier is positionable across a roadway in a deployed position to define a restraining zone and may be moved vertically to a passive position by first and second transport components. Opposite ends of the barrier are coupled to the first and second transport components, respectively, and also couple the barrier to first and second energy absorbers of differing restraintive force in order stop vehicles of varying weight. A support cable is coupled to an indicator for providing a signal indicating vehicle impact. Additionally, a series of restraining barriers and energy absorbers may provide a series of sequentially differing restraintive forces to stop lightweight and heavier vehicles. The barrier may be a net and include a lower wire below the net assuring effective trapping of autos and trucks of a variety of heights.

29 Claims, 10 Drawing Sheets

MULTIPURPOSE ENERGY ABSORBING BARRIER SYSTEM

RELATED APPLICATIONS

This application is a continuation-in part of U.S. patent application Ser. Nos. 08/549,510 and 08/549,508 both filed on Oct. 27, 1995 and now U.S. Pat. No. 5,624,203 issued Apr. 29, 1997 and U.S. Pat. No. 5,634,738 issued Jun. 3, 1997, respectively. This application also claims priority of PCT Application No. PCT/US96/13495 filed 21 Aug. 1996.

FIELD OF THE INVENTION

The present invention relates generally to energy absorbing barrier systems and, more particularly, to such systems which are capable of use with a wide range and size of vehicles and includes means for producing signals indicative of system status.

BACKGROUND OF THE INVENTION

Energy absorbing units for arresting the motion of objects or vehicles have found wide application in the past. For example, U.S. Pat. No. 2,980,213 discloses a system in which a hook trailing from a plane that has landed catches a cable extending across a runway. The ends of the cable are connected to energy absorbers. The energy absorbers each includes a coil of metal strip which absorbs kinetic energy by being plastically deformed beyond its yield point. Travel of the airplane after landing is significantly limited. Other patents disclosing energy absorbing means include U.S. Pat. Nos. 2,979,163, 3,017,163, 3,211,260 and 3,366,353. All of the aforementioned patents are commonly assigned with this application. Their disclosures are incorporated by reference herein. Such units have also been used for arresting vertical travel of an elevator whose suspension cable may have broken. More recently, such energy absorbers have been incorporated into roadway systems.

Many fatalities due to collision of a train with a vehicle have been avoided by building of automobile underpasses or train bridges so that a road will not cross railroad tracks. However, cost of widespread implementation of such construction is prohibitive. Such construction has been found to be cost justified in densely populated areas, but may still not be done in areas where a large risk may still exist. It is also desirable to improve safety where possible even at remotely located grade crossings.

Where many grade crossings are each protected by such a system, it is necessary to monitor the status of each system to know when a crash into a barrier has occurred. In populated areas, occurrence of a crash will be conspicuous. In other areas, visual inspection may be necessary. It is helpful if the organization maintaining the grade crossing protection systems can get prompt notification of a change in the status of any of dozens of unmanned systems within a region served by the maintenance organization.

There still remains a need to provide apparatus of this class of devices that will perform its usual functions for most types of cars and trucks and also stop low-slung sports cars without detriment to its effectiveness for other vehicles and to deployment and retraction functions.

Furthermore, there may be instances when the energy absorber units may be either insufficient to stop a large truck or if the energy absorber unit is sufficient to stop a large truck it can cause substantial damage to a smaller automobile or vehicle which also encounters the flexible barrier or wall. It is therefore necessary to provide an energy absorbing barrier system which is capable of stopping both large trucks and vehicles as well as smaller vehicles in an effective manner without damaging the smaller vehicles as it encounters the barrier.

Additionally, there is a lack of efficient systems available for rapidly and safely bringing to rest runaway trucks and automobiles such as occurs when a vehicle's brakes fail while descending from a mountain or the like.

Also, there is a need for a vehicle arresting security barrier system that can be easily deployed and retracted, to deal with smuggling, bomb attacks, escapes and like security contingencies.

It is therefore an object of the present invention to provide an energy absorbing barrier system including means for indicating engagement of a vehicle by the barrier.

It is a more specific object of the present invention to provide a system of the type described having a barrier capable of effectively stopping vehicles of various sizes and weight.

It is a further object of the present invention to provide a system of the type described which possesses substantial immunity to false alarms.

It is another object of the present invention to provide a system of the type described in which complexity is minimized.

It is still a further object of this invention is the provision of a universal net or barrier that can engage and stop cars and trucks.

It is still another object of this invention to provide a system that effectively stops cars and trucks with minimal damage occurring to the vehicles.

SUMMARY OF THE INVENTION

Briefly stated, in accordance with the present invention, there is provided a restraining barrier or wall positionable across a roadway in a deployed position to define a restraining zone. The restraining barrier may be moved vertically to a passive position by first and second transport means slidably mounted in first and second towers on either side of the roadway. The barrier or wall may be a metal net and/or an array of parallel or crossing cables. First and second cable means each support an opposite end of the barrier to the said first and second transport means respectively and also couple the barrier means to an energy absorbing unit with a deformable metal tape as the principal energy absorbing means.

In instances where the energy absorbing barrier system of the present invention is utilized to control and stop the movement of both trucks and automobiles, the barrier or wall can be operably attached to two separate pairs of absorber units joined in parallel. Both of the pairs of absorber units are made up of a rolled up metal tape (thick metal strip). One of the pairs of absorber units is connected between a pay-out point in the holders and the flexible barrier or wall and the other of the pairs of absorber units is attached between the pay-out point at a rigid mounting post and by means of a predetermined length of chain to the barrier or wall.

The pay-out point acts as a mechanism for causing energy absorption by bending the elongated metal wire or strip within its elastic range of deformation in multiple steps that can be effected quickly because of low inertia of the system. The number and type of bends and thickness and area of the metal can be set for a specification threat of auto speed and weight in relation to tolerable run-out length. The energy absorbing structure, per se, is of the class described in U.S. patent application Ser. Nos. 08/549,508 and 08/549,510 and in prior U.S. patents of Jackson (alone or with Van Zelm and/or Knickel) U.S. Pat. Nos. 2,979,163, 2,980,213, 3,017,163, 3,211,260 and 3,366,353, the disclosures of which are incorporated herein by reference as though set out at length herein.

The first of the pair of energy absorber units is associated directly with the barrier or wall and is of such design so as to effectively stop, without substantial damage, a lower weight vehicle such as an automobile. The second pair of energy absorber units is anchored directly to the ground by, preferably, thick concrete slabs, and disposed a predetermined distance from the barrier or wall. The energy absorber units associated therewith are capable of stopping a large weight vehicle such as a truck.

In order to prevent a lower weight vehicle, such as an automobile, from being subjected to this very high energy absorbing unit, the rolled up metal tape is not directly connected to the barrier or wall, but has a chain of predetermined length interconnecting the rolled up metal tape to the barrier. In such a manner, barrier engagement and operation with the second pair of energy absorber units does not take place when utilized to stop a lighter weight vehicle. In the event that a larger vehicle, such as a truck, continues on in its movement against the barrier or wall, the second of the two pairs of energy absorber units come into play at the extension point of the chain and stops the larger weight vehicle.

The cable means include a support cable which also responds unambiguously to the impact of a vehicle caught by the lowered barrier. The cable response is a breakage of the cable. When the support cable breaks, activation means are enabled to operate a signal system so that an indication of engagement of a vehicle by the barrier is produced at a distance. Thus, many such systems can be placed at dozens of grade crossings in a region with control by a single headquarters site and no need for manual observation at each such grade crossing.

The indication of crash is preferably made without use of a flexible umbilical cord of signal wires sliding up and down with one or both of the transport means. That is, a fixed signal activation device is provided that has a switch normally restrained from activation by the cable. Breakage of the cable allows activation.

The restraining barrier or wall also has an arresting cable or wire, below a main portion, that can be placed at a height to catch a low undercarriage vehicle portion while avoiding the wheels of a truck—about 6–18 inches above grade. The barrier or wall bottom (exclusive of the low wire) is about a foot above the low wire. One or more mid-height wires and a high wire are also provided in the barrier or wall. Vertical props are provided for assuring low wire and barrier or wall height relation to each other and to the ground. The lower restraining wire is placed behind the barrier or wall (relative to an oncoming vehicle) to assure that the mid-height wire and a wall portion will engage the vehicle before the lower wire does. This assures that the vehicle will not over-ride the lower wire and will be engaged by at least the lower and mid-height wires. Wires as used herein refers to rod, strip and cabling strung out as wires. Cabling of twisted together or braided strands of high tensile metal or high tensile plastic is preferred. Galvanized-coated steel wires are the preferred metal wire components.

An auto crashing into the flexible barrier or wall (and the lower wire) loads the first of the pairs of energy absorbing units to impart an increasing resistance to the vehicle momentum. The energy absorber comprises units in each of the side holders of the wall, each of which comprises a rolled up metal tape (thick metal strip) connected between a pay-out point within the holder and an end of the flexible barrier or wall. The pay-out point is a mechanism for causing energy absorption by bending the elongated metal wire or strip within its elastic range of deformation in multiple steps that can be effected quickly because of low inertia of the system. The number and type of bends and thickness and area of the metal can be set for a specification threat of auto speed and weight in relation to tolerable run-out length.

In the event the first of the pairs of energy absorber units is insufficient to stop the vehicle, the second of the pairs of energy absorber units takes effect when the length of chain attaching the units to the barrier is extended to its fullest length. Thereafter, the second of the pairs of energy absorber units acts as the first to bring a heavier vehicle such as a truck to rest.

It is also possible to design the barrier system of this invention in tandem arrays for load limiting, e.g. to deal with over-specification high speed auto or truck crashing the barrier. These tandem arrays are especially useful in stopping vehicles of various sizes without damage thereto. An example where such tandem arrays perform especially well is in effectively stopping runaway vehicles descending from, for example a mountain. In such an instance a series of barriers or walls with varying resistive force are sequentially attached at various points between side restraining members which may be in the form of Jersey barriers.

After a crash arrest, the apparatus can be reset by replacement of metal spool(s) in the energy absorbing mechanisms or units restraint holder(s). The columns do not need replacing. Reuse of flexible barriers or walls is optional. The up/down drives for the holders on the columns can be individual or based on a common motor at one of the columns or on the trestle with a drive linkage passing through the trestle. The elevating mechanism can be of lead screw, hydraulic or chain drive forms. Automatic and/or manual controls are provided to sense a need or timing for holder accelerating or descending drive and locking at upper, lower or (in some cases) intermediate height positions.

While the invention has been described thus far (and primarily herein) as to grade crossing usage, it is also applicable, e.g. as a security gate, in (temporary) runaway truck runout facilities and the like.

Other objects, features and advantages will be apparent from the following detailed description of preferred embodiments taken in conjunction with the accompanying drawings in which:

DETAILED DESCRIPTION OF PREFERRED EMBODIMENTS

Figures 1, 2:
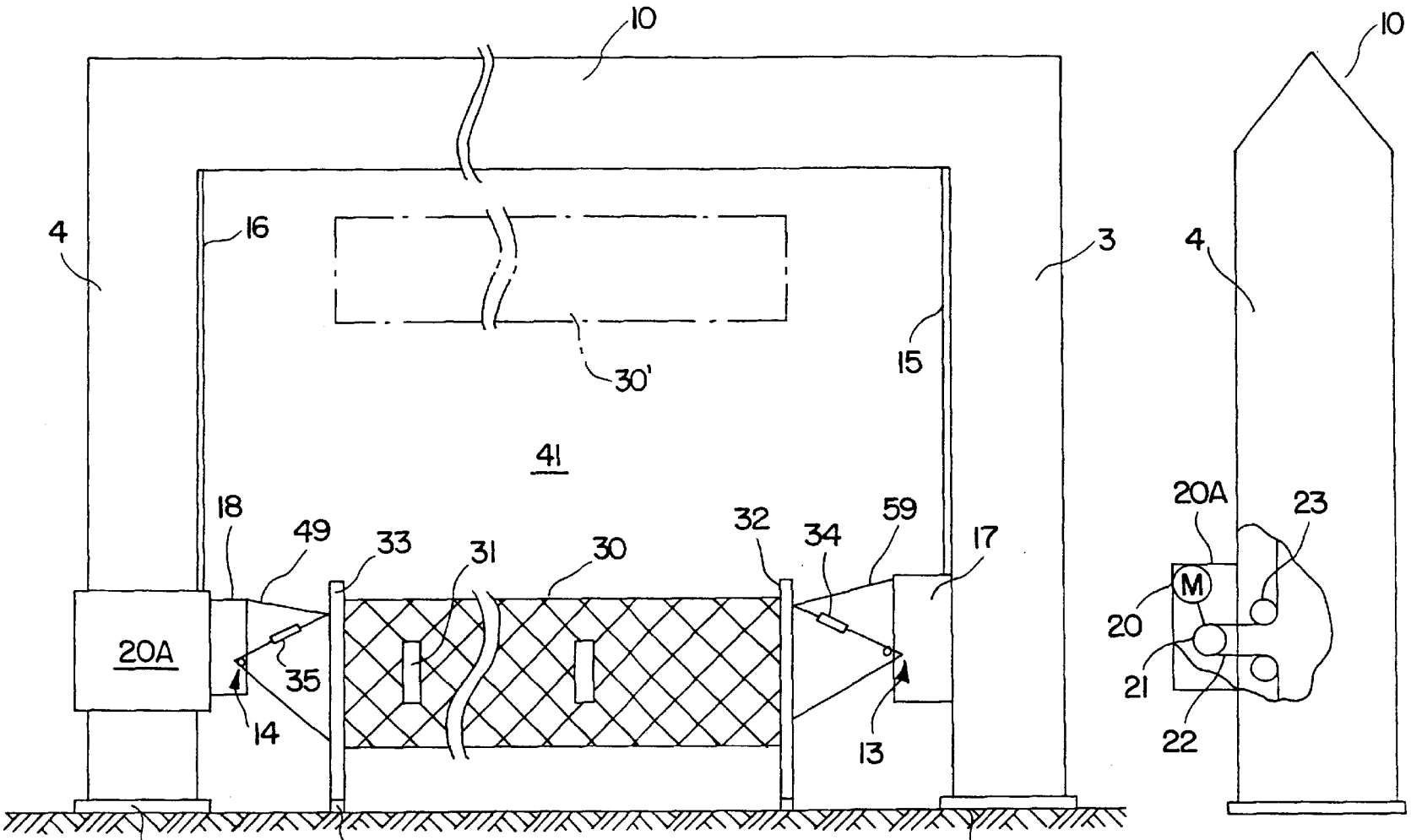
FIG. 1 is a rear elevation of a system constructed in accordance with a preferred embodiment of the present invention with the barrier in a deployed position showing net, tower and transport means components of the system.
FIG. 2 is a side elevation relative to FIG. 1.

Reference is now to FIGS. 1, 2, 5 and 6, which are respectively a rear, that is, on the side of the net away from oncoming vehicle traffic to be stopped, and a side elevation (FIGS. 1 and 2) and a plan and front elevation (FIGS. 5 and 6), to illustrate a restraining system 10 constructed in accordance with the present invention. First and second towers 3 and 4 have lower ends mounted in footings 5 and 6 on either side of a roadway 8.

The towers 3 and 4 each, respectively, support first and second transport means 13 and 14. The transport means 13 and 14 move the barrier means to one of the selectable height positions between fully deployed and fully passive positions (shown in phantom), and are slideably mounted to said first and second towers 3 and 4 respectively along guides 15 and 16. The guides 15 and 16 can comprise rollers or molybdenum disulfide impregnated nylon slippers. While Teflon® is more slippery, it may be too soft to be useful. The transport means 13 and 14 are driven by a stationary electric motor 20 (FIG. 1) with reduction gearing (not shown) between motor 20 and drive sprocket 21 for moving the transport means 13 and 14 to the selectable vertical position. Housing means 17 and 18 surround each transport means in the manner illustrated in FIG. 9, discussed below.

A fixed housing 20A attached to one of the towers, say 4, and the tower per se accommodate a motor 20, drive gear wheel 21 and passive gear sprockets 23 for a chain-drive or the like within the tower. A top crossing structure 10A connects upper portions of the towers 3 and 4 and also transmits motion from a drive side tower to a slave side tower via chain drive or other drive means known per se. One example would be a shaft S mounted within housing 20A on spaced bearings therein (not shown) and linking top pulleys of separate elevating chain drives (22, 22') of the two towers for coordinated motion where one such drive is positively driven by a motor and the other is driven via the shaft. Alternatively, electrically synchronized motors could be provided for separate chain drives or the like in each tower. Thus the transport means 13 and 14 move simultaneously and are maintained in vertical registration. Such drive arrangements are well known per se in the art. A barrier means 30, also referred to as a restraining barrier or wall, is provided for placement in a selectable position. In FIG. 1, the barrier means 30, described below, is in a deployed position at the roadway. The means 30 can be raised up to an elevated (passive) position shown in phantom at 30' or higher, preferably wholly within structure 10A for weather protection.

The restraining barrier 30 is preferably a rectangular net of a high strength plastic material (e.g. of Kevlar or of metal). It is supported for positioning at a selected vertical level, when deployed, between said first and second towers 3 and 4. The barrier 30 is suspended from the transport means 13 and 14 and is vertically movable therewith. Reflective strips 31 may be placed on the surface of the restraining barrier 30 to face oncoming traffic. Vertically disposed support rods 32 and 33 are attached to each side of the barrier 30. One or more additional support rods can be provided in the middle of the barrier. Some or all of the vertical support rods may extend down to the roadway 8 to support weight of the barrier 30 from the ground and maintain the barrier, as deployed, at a selected height.

Figure 3:
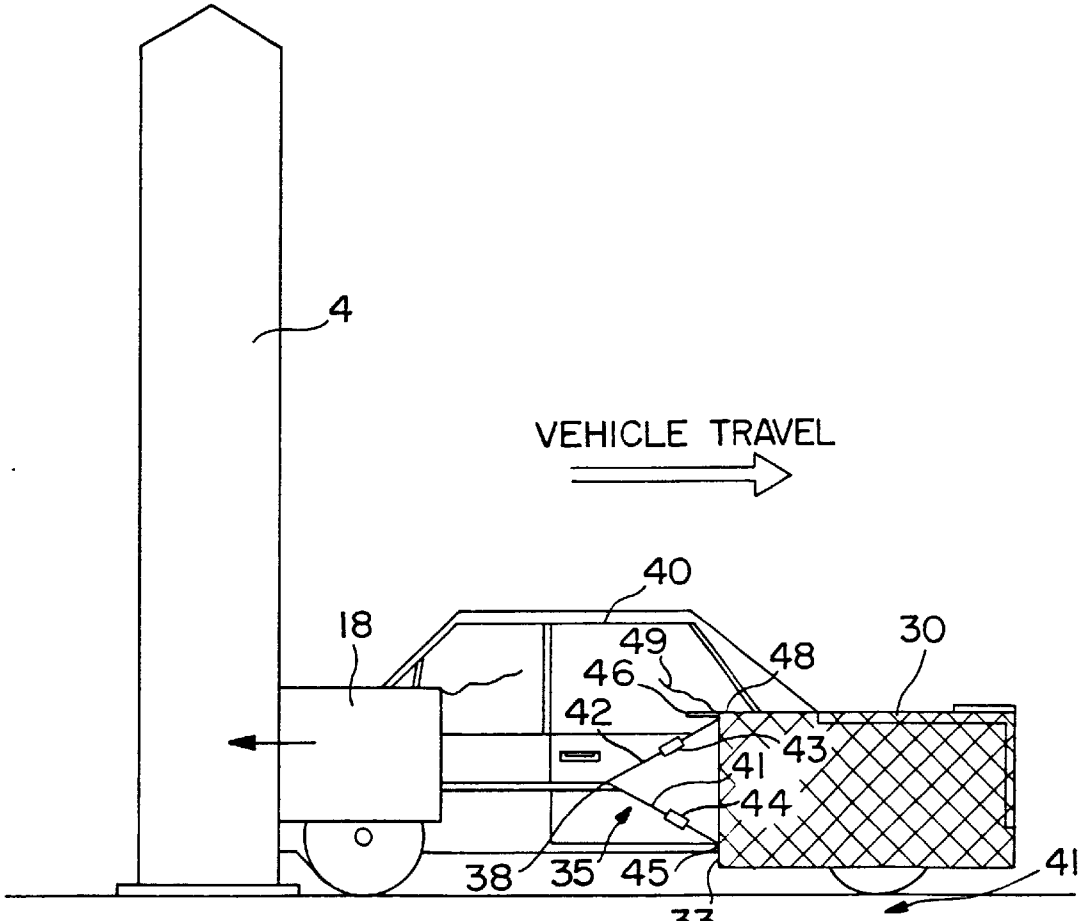
FIG. 3 is a side elevation illustrating a vehicle engaged with the FIG. 1 barrier means in the deployed position, i.e. a vehicle capture event and showing breakage of a cable element of the activation means.

A first selectable position, illustrated in FIG. 1 is one in which the barrier 30 spans the roadway 8 and is vertically positioned to block the path of a vehicle. The vehicle 40 is illustrated in FIG. 3, which is a side elevation illustrating the system and a vehicle engaging the barrier means 30. This first selectable position, illustrated in FIGS. 1 and 3, is referred to in the present description as the deployed position. A restraint zone 41 is defined in which the vehicle 40 will be contained. In a second selectable position, referred to as the passive position, the barrier 30 is positioned vertically above the roadway 8 to permit the vehicle 40 to pass through the restraint zone 41 (FIG. 1).

Figure 5:
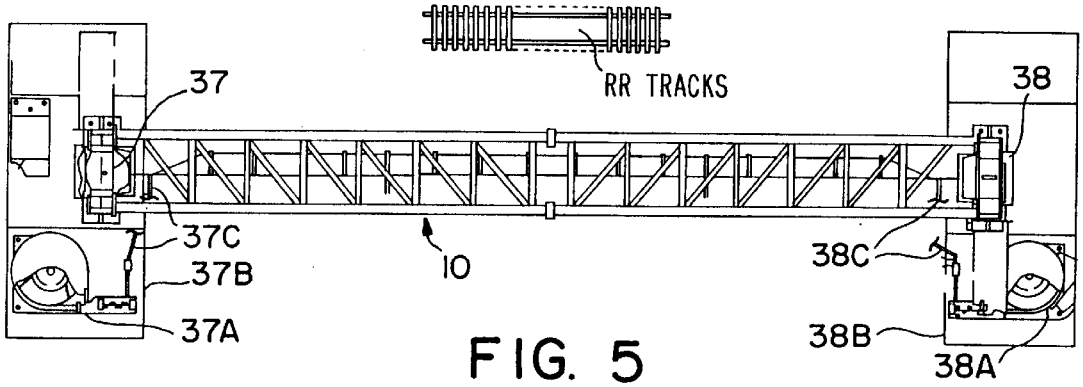
FIG. 5 is a plan view of a system constructed in accordance with a preferred embodiment of the present invention illustrating the dual pairs of energy absorber units.
Figure 6:
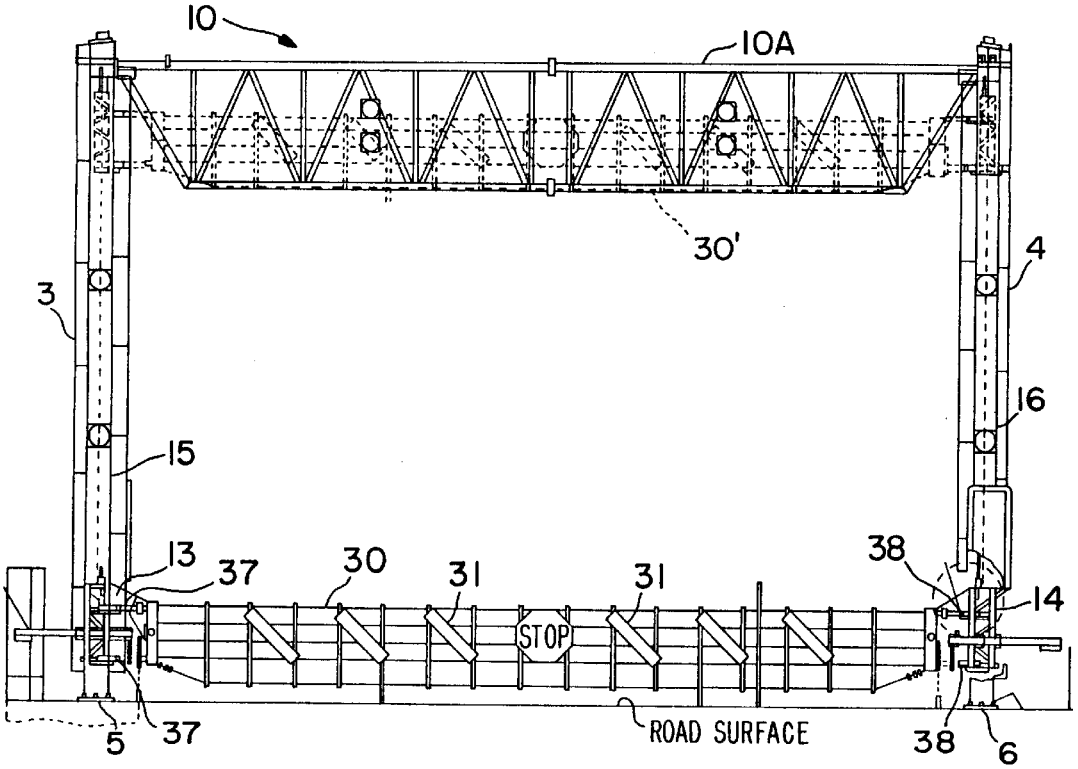
FIG. 6 is a front elevation of a system constructed in accordance with a preferred embodiment of the present invention illustrating the dual pairs of energy absorber units.

Cable means 34 and 35 each suspend an opposite span end of the barrier 30 to the first and second transport means 13 and 14, respectively. A slightly modified system is illustrated in FIGS. 5 and 6 and will be explained in greater detail below. The cable means 34 has its opposite ends connected to the support rod 32 in registration with upper and lower ends of the restraining barrier 30. An intermediate portion of the cable means 34 is supported to the tower 3 by engaging means attached to or forming a part of an energy absorber 37. The engaging portion of the energy absorber may comprise, for example, an eyelet or a roller. Similarly the cable means 35 has opposite ends affixed to the support rod 33 in registration with upper and lower ends of the restraining barrier 30, with an intermediate portion supported to the tower 4 by engaging means attached to or forming a part of an energy absorber 38. The energy absorbers comprise metal tapes T (thick metal strip) on reels within units 37, 38 that passes through dies or rollers as pulled out (by a vehicle crash into the net) to deform the tapes and transfer energy into size configuration and/or metallurgical state changes of the tape, as described in the above cited patents.

Reference is now made to FIGS. 5 and 6 of the drawings, wherein FIG. 5 shows a plan view and FIG. 6 shows a front view illustrating the oncoming position of the modified restraining system 10 of this invention. In the embodiment of the invention shown in FIGS. 5 and 6 of the drawings, the barrier 30 is shown in its deployed position while barrier 30' is shown in phantom in its raised or passive position.

The restraining system 10 as illustrated in FIGS. 5 and 6 incorporates therein a second pair of energy absorbers or energy absorber units, 37A and 38A, positioned in a fixed housing structure, 37B and 38B. Housings 37B and 38B, together with energy absorbers 37A and 38A are shown in FIG. 5 of the drawings as being positioned in front of the first and second towers 3 and 4, respectively. It should be realized, however, that these energy absorbers could also be positioned in back of the towers as well. The energy absorbers 37A and 38A are substantially identical to the energy absorbers 37 and 38, except for the resistance which they apply to the barrier 30 which is substantially greater than the resistance applied by energy absorbers 37 and 38. In other words, energy absorbers 37A and 38A have the capability of stopping a much larger or heavier vehicle such as a truck.

If such resistance is used alone, and a smaller vehicle such as an automobile was engaged by barrier 30, the lighter or smaller vehicle could sustain substantial damage as a result of its impact with barrier 30. Therefore, the embodiment shown in FIGS. 5 and 6 utilize less resistive energy absorbers 37 and 38 in conjunction therewith. As shown in FIGS. 5 and 6, the energy absorbers 37A and 38A each have a chain 37C and 38C, with links made preferably of steel or other high strength material of a length sufficient to permit barrier 30 to be raised from its deployed position to its passive position. This length of chain 37C and 38C is also of sufficient predetermined length so as to prevent the actuation of energy absorbers 37A and 38A from taking place during the stopping of a lighter vehicle, such as an automobile, by barrier 30 in conjunction with energy absorbers 37 and 38.

Figure 7:
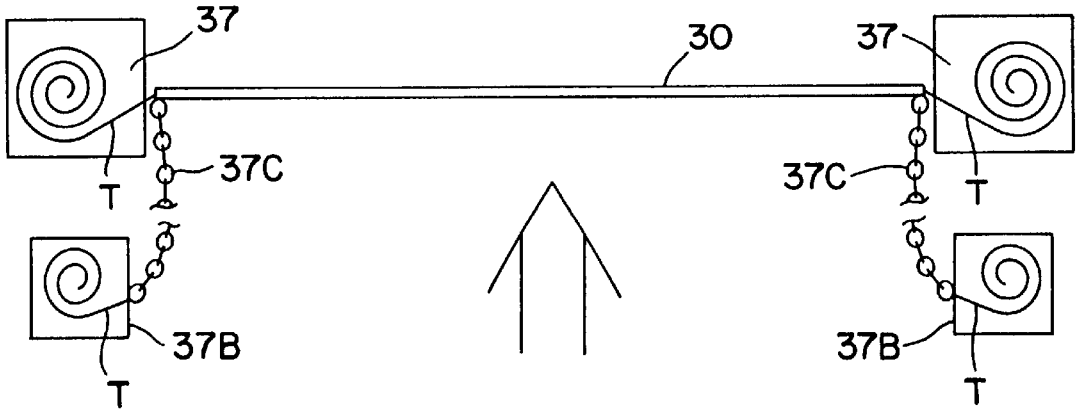
FIGS. 7 and 8 are schematic illustrations of the invention illustrating the deployment of the dual energy absorbers in sequence.
Figure 8:
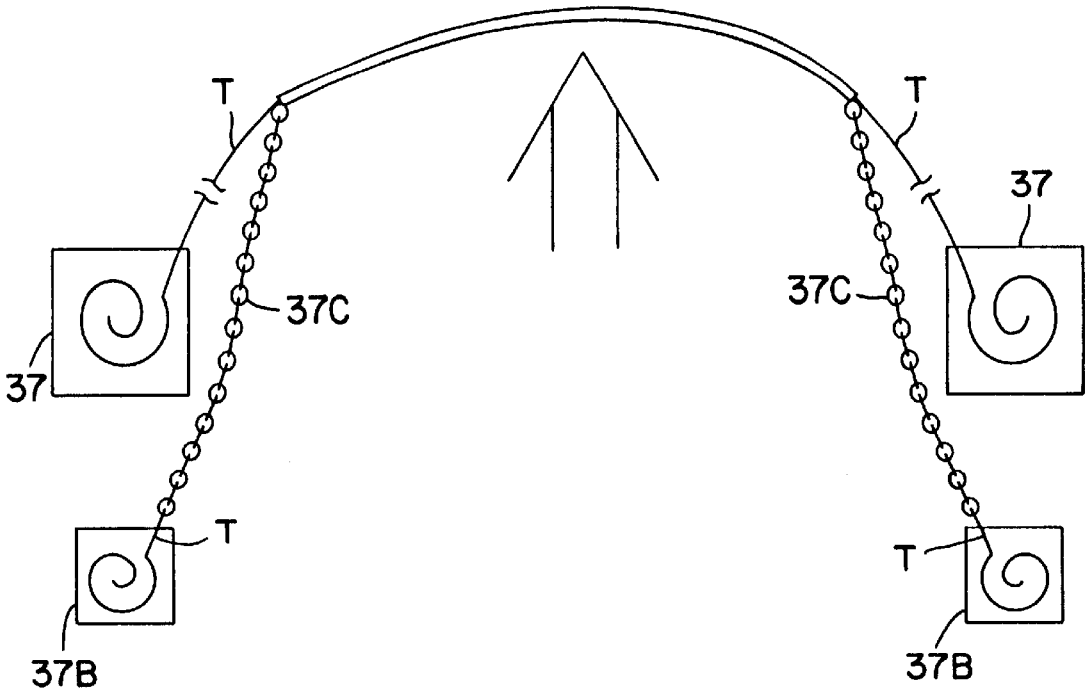

The extension of chains 37C and 38C are clearly shown in the schematic illustration of FIGS. 7 and 8. In FIG. 7, the barrier 30 is in its deployed position prior to engagement by a vehicle and in FIG. 8 a vehicle has impacted barrier 30 to the extent where the chains 37C and 38C are extended to its maximum length. In that position, the smaller or lighter vehicle, such as an automobile, has already been stopped. In the event that a truck or very heavy vehicle engages the barrier 30, the more resistant energy absorber 37A and 37B come into effect. The more energy absorbent metal tapes now play out against the larger and heavier vehicles, such as a truck, in order to bring the truck to a full stop.

It should also be recognized that a further number of energy absorbers, all based upon the weight and size of vehicles to be stopped, could also be utilized in conjunction with barrier 30. The housings 37B and 38B are anchored in a thick concrete slab and become a permanent fixture. When placed in front of the towers 3 and 4 further protective cushioning may be positioned in front thereof in case a vehicle veers off course and strikes the anchored concrete slabs which hold the housings 37B and 38B in place.

With respect to either of the above embodiments, a first sensing cable 49 is affixed to one end of the barrier 30 at the support rod 33 and extends to the transport means 14. The sensing cable 49 is coupled to activator means further described below with respect to FIGS. 9 and 10. The sensing cable 49 helps maintain the barrier 30 in its vertical disposition. Similarly, a sensing cable 59 is connected from one end of the barrier 30 at support rod 32 to the transport means 13. The sensing cable 59 is connected to activator means 37 further described below for response to a engagement of a vehicle by the barrier, and also helps to maintain the barrier 30 in its vertical position.

In FIG. 3, the barrier 30 is in the deployed position in a situation in which the barrier 30 has blocked the path of the vehicle 40 in the restraint zone. The barrier 30 has been engaged. The cable assembly 35 has transmitted force to the energy absorber 38 to pull out its tape thereby converting vehicle momentum to tape modification force while the tape is reeled out. A plastically deformed portion of the tape T is visible in FIG. 3. Similarly, the cable 34 has transmitted force to and pulled the plastically deformed metal tape from the energy absorber 37. The sensing cable 49, which was fastened to a substantially nondeformable support point, has broken. On the other side cable 59 has similarly broken. The system can work with one or both of such breaks.

With respect to the embodiment of the invention shown in FIGS. 5 and 6, in the event a vehicle is not stopped by the energy absorbers 37 and 38, absorbers 37A and 38A are utilized in parallel with absorbers 37 and 38 as described above. After runout of the steel tape of absorbers 37 and 38 the chains 37C and 38C activate the absorbers 37A and 38B. This secondary system comes into effect in the case of heavy vehicles such as trucks which are not stopped by the initial absorbers 37 and 38. Yet, in instances when absorbers 37 and 38 are sufficient to stop a lighter vehicle such as an automobile, the more resistant absorbers 37A and 38A do not take effect. More specifically, the steel tape of absorbers 37 and 38 may have, for example, a cross section of 2 inches by 0.05 inches, while the more resistive absorbers 37A and 38A may utilize steel tape, for example, of a cross section of 2 inches by ⅜ inch. Therefore, the lighter vehicles are stopped by barrier 30 with virtually no damage thereto.

Figure 4:
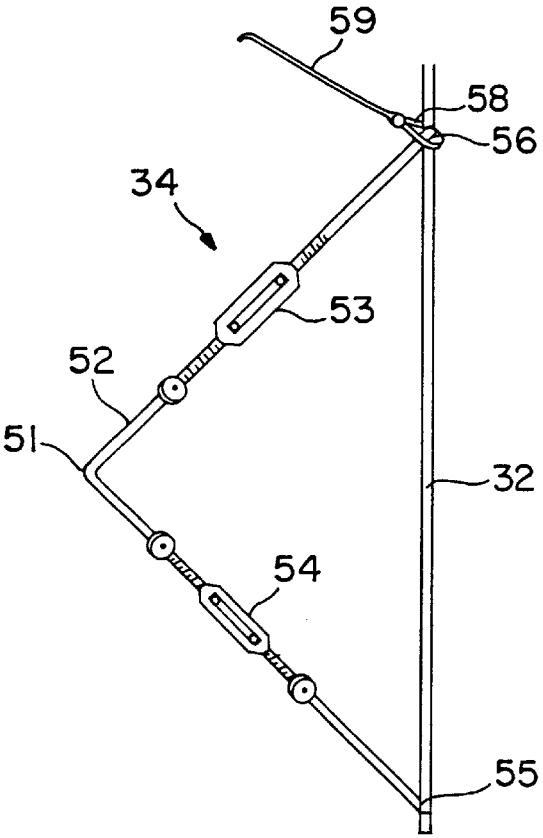
FIG. 4 is a partial, detailed view illustrating in greater detail cable means supporting the barrier means of said embodiment.

FIG. 4, a partial detailed view, further illustrates the connections of cable assembly 34 (also representative of cable assembly 35) to the barrier 30 for restraining the vehicle 40. The cable means 34 includes a cable 52 having a central portion 51 for engaging the energy absorber 37. The cable 52 includes turnbuckles 53 and 54 for adjusting the length of the cable 52 on either side of the central portion 51. The sensing cable 59 is affixed to an upper portion of the support rod 32 by a tie or loop 58 at a junction 56. At the junction 56, the loop 58 may go around the end of the cable 52 where it is affixed to the support rod 32. Similarly, as seen in FIG. 3, the cable means 35 includes a cable 42 having a central portion 41 for engaging the energy absorber 38. The cable 42 includes turnbuckles 43 and 44 for adjusting the length of the cable 42 on either side of the central portion 41. The sensing cable 49 is affixed to an upper portion of the support rod 33 by a tie or a loop 48 at a junction 46. At the junction 46, the loop 48 may go around the end of the cable 42 where it is affixed to the support rod 33.

Figure 9:
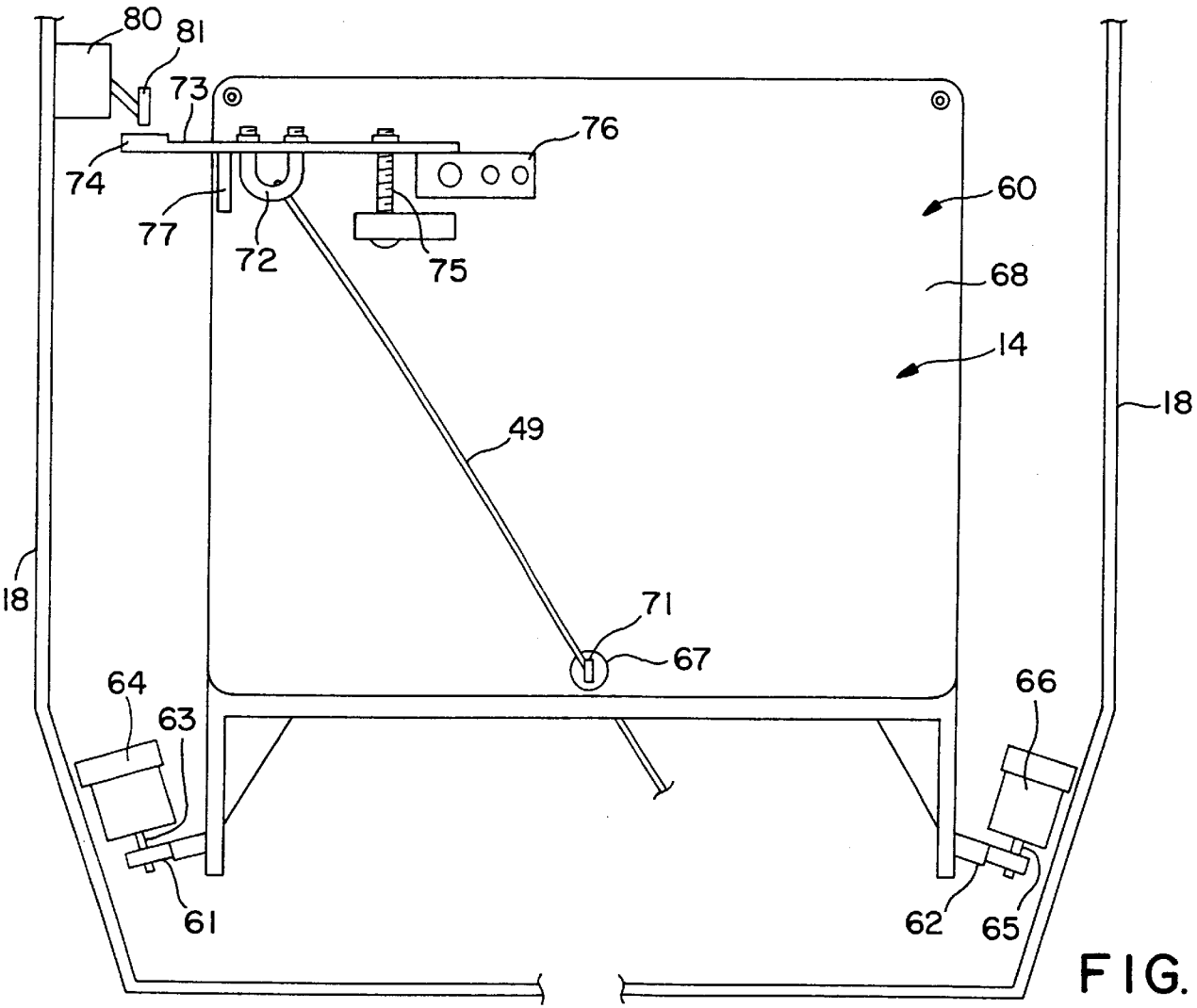
FIGS. 9 and 10 are partial detailed plan and elevation views illustrating the relative positions of activator and indicating means in the transport means and the tower respectively when the barrier is in the deployed position.
Figure 10:
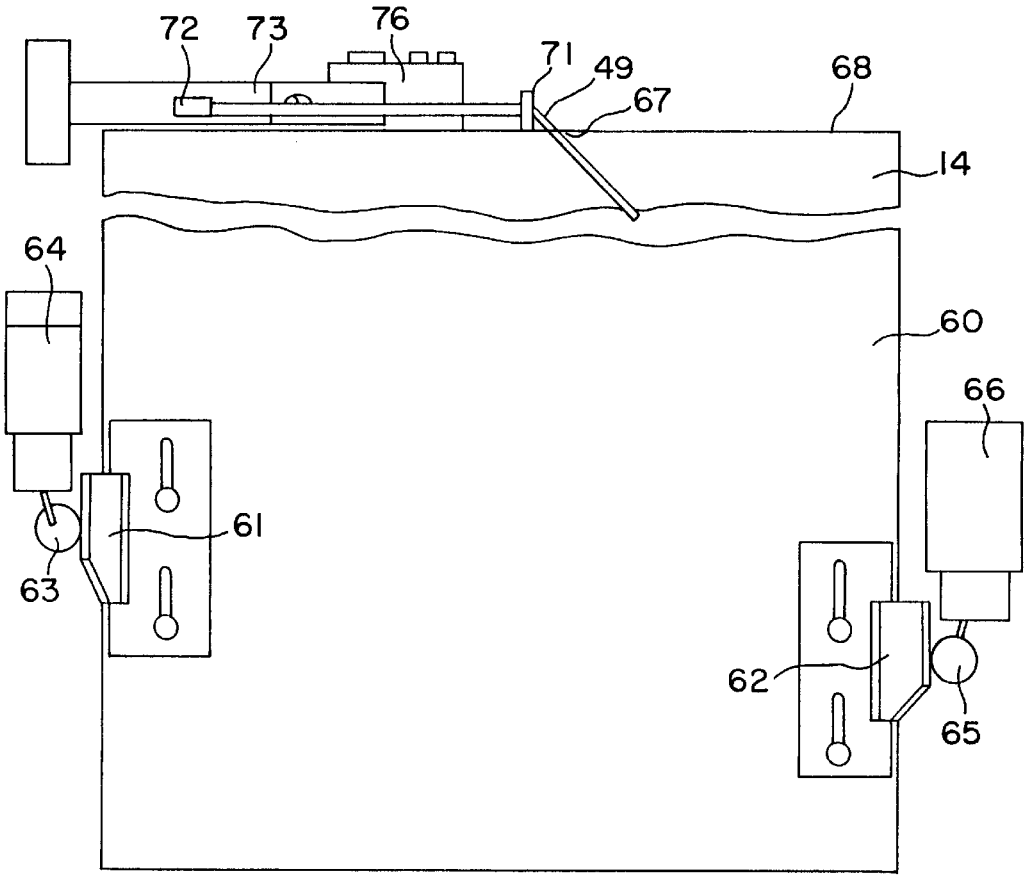
Figure 11:
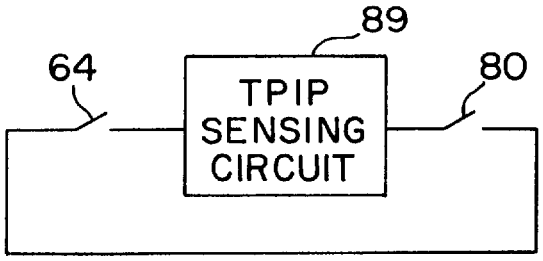
FIG. 11 is a partial, detailed view illustrating operation of the vehicle capture indicating means.

The sensing cable 59 is connected to the activator means, as further described with respect to FIGS. 9 and 10 as well. FIGS. 9 and 10 are partial detailed plan and elevation views illustrating the juxtaposition of activator and indicating means in the transport means 13 and 14 and the towers 3 and 4, respectively, when the barrier 30 is in the deployed position. While these FIGS. illustrate the components in the tower 4, they are illustrative of the entire system in that the arrangement in the tower 3 may be the mirror image of FIGS. 9 and 10. FIG. 11 is a diagram further illustrating indicating means. FIG. 11 further illustrates control circuitry 89 which may be in the tower 4 or coupled to switch means 64 (described below) from a remote location.

The transport means 14 comprises a carriage 60 having a platform 68. An arm 61 projects from the carriage 60 for engaging an activator arm 63 of a limit switch 64 mounted to the tower 4. For further reliability, a second arm 62 projects from the carriage 60 for engaging an activator arm 65 of a limit switch 66 mounted to the tower 4. The limit switches 64 and 66 sense when the carriage 60 is in a vertical position corresponding to the deployed position of the barrier 30. The outputs of the switches 64 and 66 are each connected in accordance with desired control functions.

An end of the sensing cable 49 is illustrated as being secured to the transport means 14 (FIG. 9). The cable 49 extends over a bearing surface 71 through an aperture 67 in the platform 68 of the carriage 60 and out of a cover wall of tower 4 via a gasket lined opening. The end of the cable 49 is connected at a tie point 72 to activator means 73, comprising a lever arm, and also referred to as the arm 73. A supported end of the arm 73 is connected to a pivot 76. The cable 49 pulls the arm 73 to rest against stop means 77. A free end of the arm 73 comprises a switch engaging pad 74. Biasing means in the form of a coil spring 75 urges the arm 73 away from the stop means 77. However, the biasing force of the spring 75 is selected to be insufficient to overcome the force applied through the cable 49 urging the arm 73 against the stop means 77. A limit switch 80 is mounted to the tower 4 and has a contact-operating activator arm 81 mounted in registration with the path of the switch engaging pad 74.

In response to a collision, as illustrated in FIG. 3, the cable 49 breaks. Consequently, there is no force counteracting the spring 75. The spring 75 urges the arm 73 so that the pad 74 engages the activator arm 81 to operate the switch 80. The control circuitry 39 produces an output in correspondence with the state of the switch 64. The output of the circuitry 39 may comprise local or remote alarms, and may also perform other desired control functions, including—e.g.—a telephone and an auto-dialer to report a vehicle restraint incident to a remote maintenance headquarters.

Figure 12:
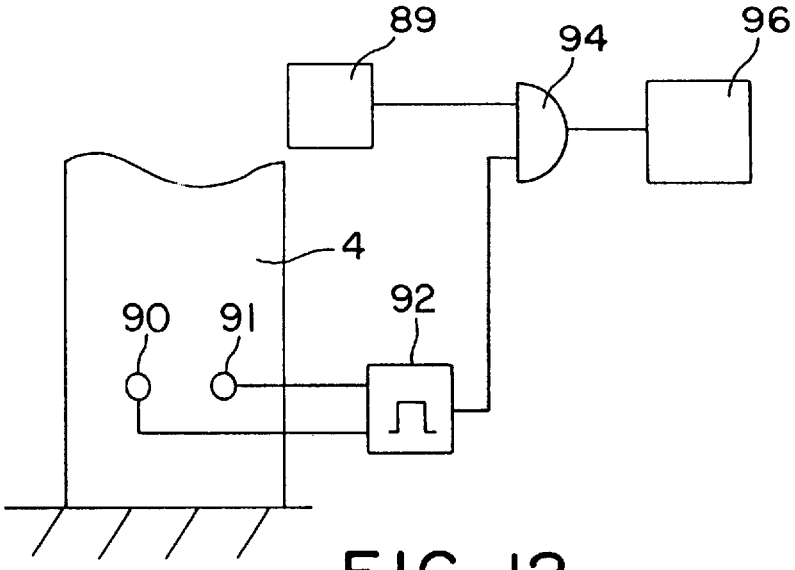
FIG. 12 is a partial, detailed view of an alternative form of means for detecting engagement of a vehicle by the barrier.
Figure 13:
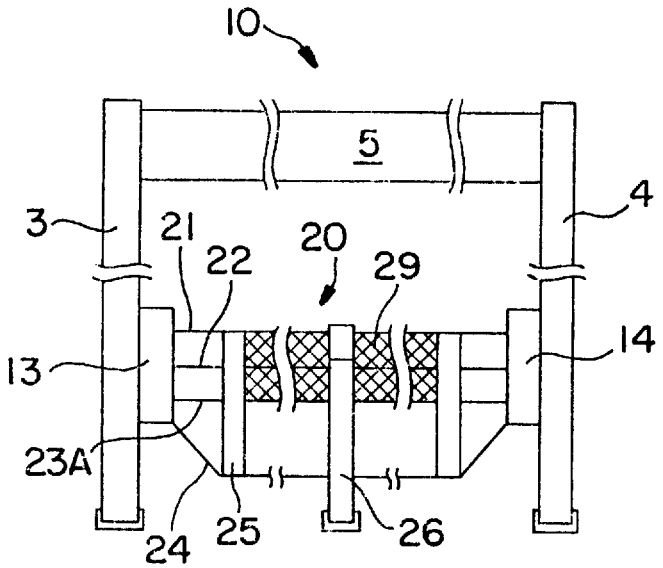
FIG. 13 is a front view (as seen from a vehicle approaching the grade crossing) of a vehicle arresting system constructed in accordance with a preferred embodiment of the present invention, with the barrier in a deployed position and incorporating therein the modified barrier or wall.

FIG. 12 is a partial, detailed view of one tower, e.g. the tower 4 comprising alternative, or additional means for sensing motion of an object in excess of a preselected speed through the restraint zone 41. First and second conventional photosensors 90 and 91 are included in a sensor system 92. The sensors 90 and 91 are mounted for sensing the presence of an object within the line of sight of each photosensor. The sensors 90 and 91 are mounted within a vertical range for sensing motion at a level expected to correspond to that of a passing vehicle, nominally 20 inches up from road grade. There are many applications in which a range of zero to four feet will have utility. The sensor system utilizes conventional circuitry and produces a signal when the sensors 90 and 91 sequentially sense the presence of an object within a preselected period of time. The horizontal spacing between the sensors 90 and 91 is a function of many factors, such as that of the timing circuitry in the sensor system 92 to sense how long it takes for a vehicle to reach from a point in line with the sensor 90 to a point in line with the sensor 91. One convenient distance is three feet. This distance between the sensors 90 and 91 becomes a known constant. By relating the time difference between production of a response at each sensor to this distance, speed of a vehicle passing the sensors 90 and 91 may be easily calculated. The sensors could be used either to calculate actual speed or to sense whether a particular threshold is exceeded. An output from the photosensor system 92 could replace or be combined with the output from the limit switch 80 (FIGS. 9–11).

FIG. 12 further includes a block diagram of circuitry useful in implementing the present invention. A schematic illustration is not provided since the block diagram and teachings of the operation herein will readily disclose the necessary structure to those skilled in the art. A sensing circuit 89 is illustrated which receives an input enabled by the limit switch 80. The output state of the sensing circuit 89 changes when the circuit that includes limit switch 80 provides an output indicative of a collision. The output of sensing circuit 89 is connected to AND gate means 94. The sensor circuit 92 is connected to another input of the AND gate means 94. When the sensors 90 and 91 sense entry of a vehicle 40 into the restraint zone 41 at level of at least the predetermined velocity, the sensing circuit 92 provides an output indicative thereof to the gate 94. Upon coincidence of the indicated signals at the inputs to the gate 94, an output is provided to operate crash indicator means 96. As noted above, the indicator means may comprise a local alarm and, for remote monitoring, may further comprise telephone, radio or other communication means pending the signal to a remote maintenance facility.

The above described structure will allow many hundreds to thousands of deployments and retractions of the barrier, without a crash incident. The sensing structure is not disturbed by the many normal deployments/retractions and remains in readiness to operate reliably to send a signal when a crash does occur. The sensing structure will not give false alarms in response to the roadway vibrations of truck traffic, vehicles slowly moving up to a deployed net or other non-crisis situations. This reliability that assures availability, but avoids false triggering, avoids needles down time (and traffic tie-ups) at grade crossings and the like.

Referring now to FIGS. 13–16, the system 10 comprises towers 3, 4 and a roof crossing 5 (which can serve as a storage location for a retracted wall). Transport systems (elevators) 13 and 14 are provided on towers 3, 4, respectively. Each transport system supports ends of the barrier assembly 20A, which comprises cables 21A, 22A, 23A, 24, clamping assemblies 25 and ground (G) supports 26 tied to certain of the clamp assemblies. Bolts 27 and nuts 28 are provided at locations B to tie strip elements 25-1 and 25-2 together about the cables and to hold 25 and 26 together. Only one end of barrier assembly 20 is shown; the other end is a mirror image.

Figure 14:
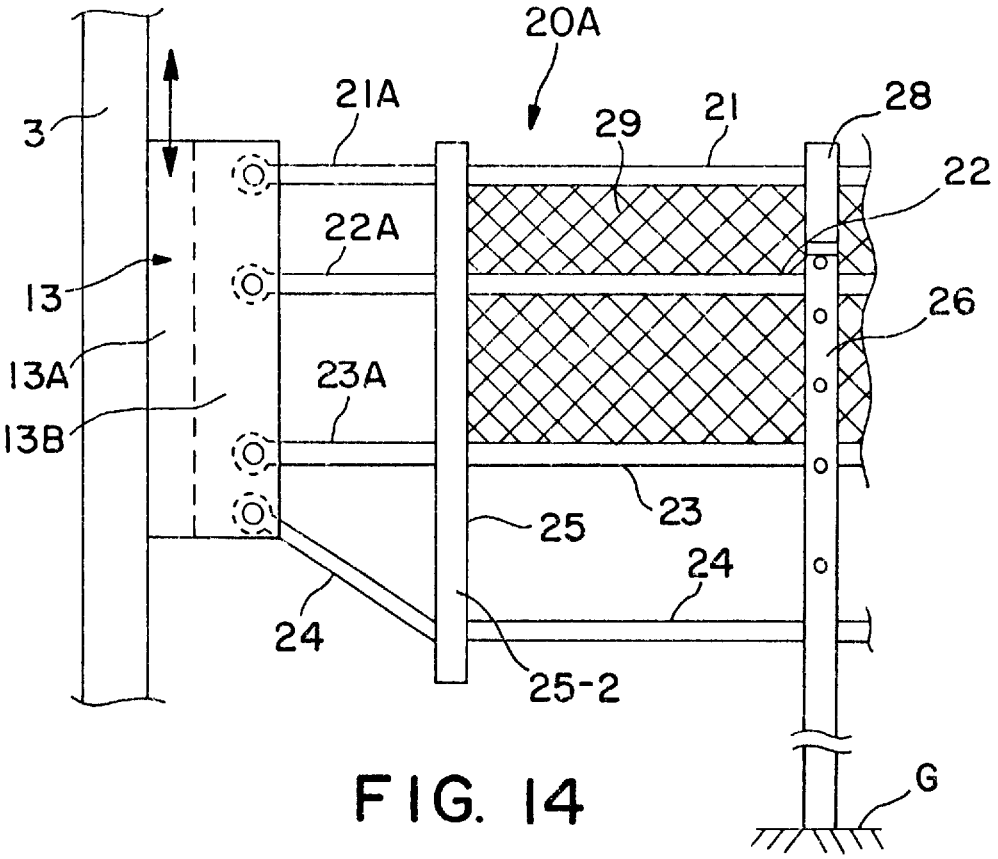
FIG. 14 is a partial front view of the net portion of the system and cables or wires related to the barrier or wall of FIG. 1.
Figure 15:
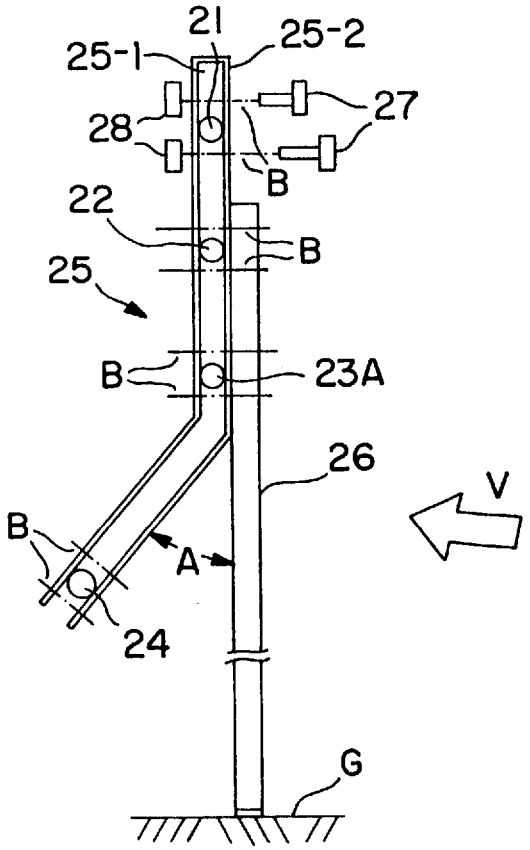
FIG. 15 is a side view of FIG. 14.
Figure 16:
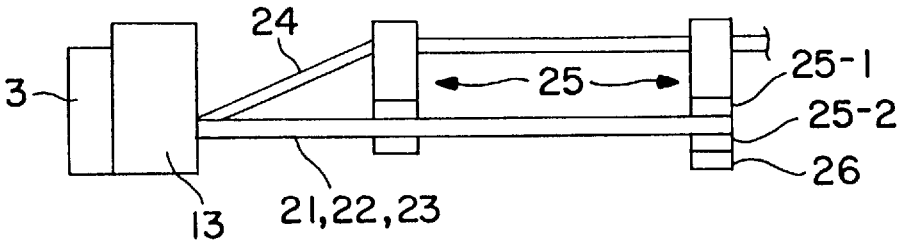
FIG. 16 is a partial top view of the barrier or wall portion of FIG. 14.

As shown in FIG. 14 the transport system 13 (and similarly the transport system 14 of FIG. 13, not shown in FIG. 14) has a holder 13 with segments 13A, 13B, the latter (13B) being detachable to play out at the end of a steel tape (not shown). The steel tape is spooled up on a reel or the like and plays out through a bending die as explained in the above cited patents.

The bend back of strips 25 relative to a vehicle approach (arrow A, FIG. 3) is in an angle A range of 30 to 60 degrees and, as mentioned above, cable 24 is at 6–18 inches above the ground and a foot (plus or minus 6 inches) below the net bottom and cable 23A. These features serve to give a proper sequence of engagement of a vehicle so that the barrier assembly will not be dragged under the vehicle with a high bumper and/or short bumper to front wheels horizontal distance, or allow a low slung car or other vehicle with a low bumper and front end, and/or long bumper to front wheels distance, to tunnel under the wires and net elements of the barrier assembly.

The discovery of these problems and means for solution of the same arise through this invention. It is convenient to express horizontal bumper to front wheel distances as bumper to wheel axis distance. In the case of a truck that short distance and the large wheel (tire) size put the wheel essentially adjacent the front bumper. On the other hand making passenger vehicles (sports cars, some economy cars) have a long bumper to wheel axis distance and smaller wheels. The set back (angle, distance) of the lower wire relative to the wall accommodates that whole range of differences.

Strips 25 are spaced at 2–4 foot intervals and strips 26, whether or not combined with strips 25 as shown, are at 2–8 foot intervals. The net 29 and cables 21A, 22A, 23A, 24 are held taut by holders 13, 14; they have very little sag or buckling and such limited tendency to sag as they have is counter-acted by the strips 25, 26.

The invention while described re its usage in railroad grade crossings above can also be used as a security device to prevent forced entrance of vehicles to buildings and grounds at gateways, at the ends of piers and for other purposes equivalent to grade crossing usage.

It should be noted that bi-directionality can be established easily by reversal of the orientation of strips 25 (i.e. having lower portions 25B angle back in a direction opposite to the one shown).

Figure 17:
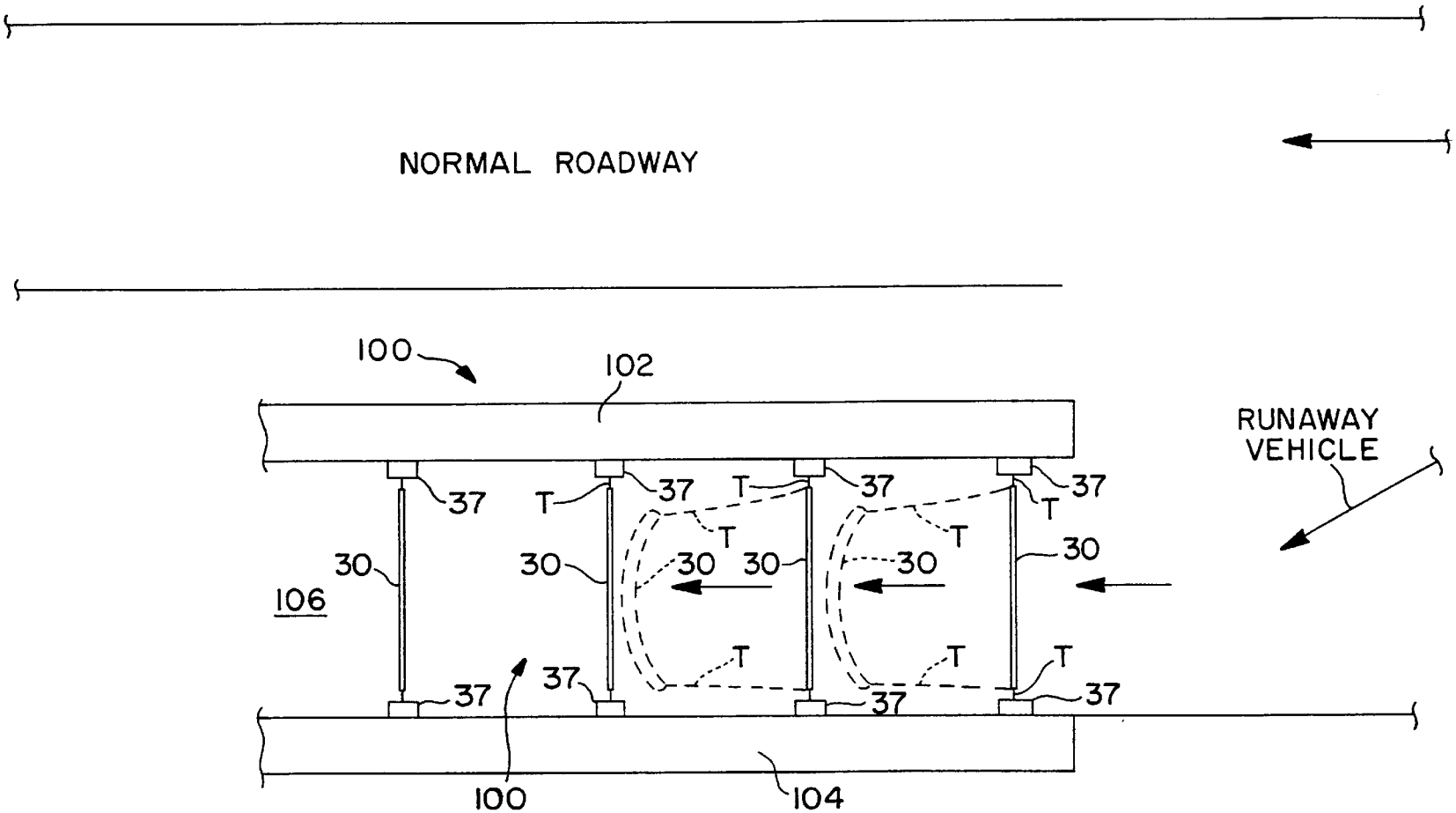
FIG. 17 is a plan view of a further embodiment of the high energy barrier system of this invention utilizing a series of sequentially arranged barriers or walls.

Another embodiment of this invention is illustrated in FIG. 17. FIG. 17 shows a plan view of a normal roadway coming from a higher elevation such as a mountain in which it is necessary to provide runaway space for trucks and automobiles who have lost their brakes as a result of heavy braking which occurs when descending a steep incline or mountain road. The barrier assembly 100 of this invention is an alternative to a runaway stopping lane having a reverse incline made with a soft sand roadway to stop the runaway vehicle. Barrier assembly 100 can efficiently stop both a heavy vehicle such as a truck and a lighter vehicle such as an automobile without causing substantial damage to the vehicle. Although the embodiment shown in FIG. 17 of the drawings is primarily utilized in conjunction with a mountain roadway, it should be understood that barrier assembly 100 can also be utilized in numerous other environments where it is necessary to stop both heavy and light vehicles.

More specifically, barrier assembly 100 is made up of a pair of side barriers 102 and 104 which could for example be in the form of a series of Jersey barriers or guard rails. The side barriers 102 and 104 are positioned parallel to one another with a standard roadway 106 therebetween. Spaced sequentially between the side barriers 102 and 104 is the barrier assembly 100 comprising a series of barriers or walls 30 similar to the type described above with the other embodiments of this invention. Each of the barriers or walls 30 are attached at opposite ends thereof to the side barriers 102 and 104 by means of energy absorber units 37 also of the type described hereinabove.

In order to prevent damage to the smaller vehicles entering the barrier assembly 100 this embodiment of the invention includes a series of spaced apart barriers or walls 30 of differing resistive or restraining force. The initial one or two barriers 30 (although not limited to that number) engaged by a runaway vehicle are restrained by steel tapes T having less resistive force then the steel tapes T utilized to restrain the barriers positioned thereafter. For example, the initial two barriers 30 may be restrained by stainless steel tapes having a cross section of 2 inches by 0.05 inches while the more restraintive barriers 30 utilized in order to stop a heavier vehicle such as a truck may have a cross section dimension of 2 inches by ⅜ inch. Although these dimensions are given for purposes of example, they may vary in accordance with the number of barriers utilized and the weight and size of vehicles to be stopped.

If a heavier restraining force was utilized for the initial barrier, it would be capable of stopping a runaway truck effectively in a short distance, however, if the runaway vehicle was a smaller, light weight vehicle such as an automobile, the heavier restraining force could cause extensive damage to the front end of a lighter vehicle as well as cause injury to the passengers. Consequently, by placing the less restrained barriers or walls 30 at the beginning of the barrier system 100 of this invention as shown in FIG. 17, the lighter weight vehicle is brought to a stop or substantially to a stop prior to engaging the more restraintive barriers 30.

FIG. 17 also illustrates, in phantom, the extended barrier 30. In the event of a truck impacting the initial less restraintive barriers 30, the truck will slow down to some extent and then upon impacting the more restraintive barrier 30 will also be brought to rest in a predetermined amount of time. Consequently, barrier system 100 as shown in FIG. 17 is ideal for effectively stopping both light weight vehicles and heavier vehicles.

In this embodiment, although the sequential barriers 30 are attached directly to the side barriers 102 and 104 by energy absorbers 37, it would also be possible to use a series of towers (as shown in FIG. 1) for elevating the barriers or walls 30 if such usage is determined to be more effective under certain circumstances. In addition, under certain circumstances, barriers or walls 30, each utilizing pairs of energy absorbers as shown in FIGS. 5 and 6 could be incorporated in the embodiment of barrier system 100 as well. Additionally, each of the barriers could utilize the additional strips described in FIGS. 13–16 in order to aid in the halting of smaller light weight vehicles.

The foregoing specification has been written with a view toward enabling those skilled in the art to construct many different forms of energy absorbing barrier system in accordance with the present invention.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A restraining barrier system comprising:

first and second vertically disposed towers, having a restraint zone defined between the lower portions thereof, first and second transport means slidably mounted to said first and second towers respectively, drive means for moving said transport means to selectable vertical positions, at least one of said transport means comprising a first energy absorbing means for providing a first predetermined restraining force, a restraining barrier means for support between said first and second transport means and being vertically movable therewith, means for supporting said barrier means to said first and second transport means and for coupling said barrier means to said first energy absorbing means, said selectable positions including a deployed position in which said restraining barrier means blocks the path of travel of a vehicle through the restraint zone and a passive position in which said restraining barrier is positioned to permit a vehicle to pass therethrough, at least one second energy absorbing means for providing a second predetermined restraining force, and said second predetermined restraining force being greater than said first predetermined restraining force, a support system, said second energy absorbing means interconnected between said barrier means and said support system and including means for activating said second energy absorbing means after activation of said first energy absorbing means, said first and said second energy absorbing means being joined in parallel, whereby a vehicle of a predetermined weight range can be substantially stopped by said first energy absorbing means upon said vehicle engaging with said barrier means and a vehicle of a weight heavier than said predetermined weight range can be substantially stopped by said second energy absorbing means upon said vehicle engaging with said barrier means.

2. A restraining barrier system as defined in claim 1 wherein said means for activating said second energy absorbing means comprises a high strength element of predetermined length interconnected between said second energy absorbing means and said barrier means.

3. A restraining barrier system as defined in claim 2 wherein said predetermined length of said element is of sufficient length to permit said barrier means to be moved between said deployed position and said passive position without activating said second energy absorbing means.

4. A restraining barrier system as defined in claim 3 wherein said element comprises a high strength steel chain.

5. A restraining barrier system as defined in claim 1 wherein each of said transport means comprises a separate first energy absorbing means.

6. A restraining barrier system as defined in claim 5 comprising a pair of said second energy absorbing means.

7. A restraining barrier system as defined in claim 1 further including means for indicating the status of said restraining barrier means.

8. A restraining barrier system as defined in claim 7 wherein said status indicating means comprises:

at least one sensing cable means coupling an end of said barrier means to at least one of said first transport means, indicator means for indicating operation of said barrier means for restraining a vehicle, activator means for operating said indicator means, said activator means comprising an element coupled to said sensing cable means such that said activator means is impeded by said sensing cable means from operating said indicator means and said activator means being operated in response to breaking of said sensing cable means in a crash event.

9. A restraining barrier system as defined in claim 1 wherein said restraining barrier means comprises a flexible wall and at least one low wire disposed below and behind the wall, the wall having a height of at least four feet, said low wire distance behind and below the wall being sufficient to assure capture of a low vehicle with a long bumper-forward wheel axis distance while avoiding capture of the wall under forward wheels of a truck or like high vehicle with a low bumper-forward wheel axis distance.

10. A restraining barrier system as defined in claim 9 and further comprising multiple additional wires spanning the wall in its span direction.

11. A restraining barrier system as defined in claim 10 further comprising vertical strips arranged along the net and maintaining the relative spacing of net and wires.

12. A restraining barrier system comprising:

at least one pair of fixed side restraints defining a restraint zone therebetween, at least one of said pair of side restraints comprising a first energy absorbing means for providing a first predetermined restraining force, a restraining barrier means for support between said pair of fixed restraints, means for supporting said barrier means to said pair of fixed restraints and for coupling said barrier means to said first energy absorbing means, at least one second energy absorbing means secured between a restraint and said barrier means for providing a second predetermined restraining force, said second predetermined restraining force being greater than said first predetermined restraining force, and means for activating said second energy absorbing means after activation of said first energy absorbing means, said first and said second energy absorbing means being joined in parallel, whereby a vehicle of a predetermined weight range can be substantially stopped by said first energy absorbing means upon said vehicle engaging with said barrier means and a vehicle of a weight heavier than said predetermined weight range can be substantially stopped by said second energy absorbing means upon said vehicle engaging with said barrier means.

13. A restraining barrier system as defined in claim 12 wherein said means for activating said second energy absorbing means comprises a high strength element of predetermined length interconnected between said second energy absorbing means and said barrier means.

14. A restraining barrier system as defined in claim 13 wherein said element comprises a high strength steel chain.

15. A restraining barrier system as defined in claim 12 wherein each of said side restraints comprises a separate first energy absorbing means.

16. A restraining barrier system as defined in claim 15 comprising a pair of said second energy absorbing means.

17. A restraining barrier system as defined in claim 12 further including means for indicating the status of said restraining barrier means.

18. A restraining barrier system as defined in claim 17 wherein said status indicating means comprises:

at least one sensing cable means coupling an end of said barrier means to at least one of said first transport means, indicator means for indicating operation of said barrier means for restraining a vehicle, activator means for operating said indicator means, said activator means comprising an element coupled to said sensing cable means such that said activator means is impeded by said sensing cable means from operating said indicator means and said activator means being operated in response to breaking of said sensing cable means in a crash event.

19. A restraining barrier system as defined in claim 12 wherein said restraining barrier means comprises a flexible wall and at least one low wire disposed below and behind the wall, the wall having a height of at least four feet, said low wire distance behind and below the wall being sufficient to assure capture of a low vehicle with a long bumper-forward wheel axis distance while avoiding capture of the wall under forward wheels of a truck or like high vehicle with a low bumper-forward wheel axis distance.

20. A restraining barrier system as defined in claim 19 and further comprising multiple additional wires spanning the wall in its span direction.

21. A restraining barrier system as defined in claim 20 further comprising vertical strips arranged along the net and maintaining the relative spacing of net and wires.

22. A restraining barrier system comprising at least one pair of fixed side restraints defining a restraint zone therebetween, a plurality of energy absorbing means for providing respective predetermined restraining forces, a plurality of restraining barrier means for support between said pair of fixed side restraints, means for supporting each of said barrier means to said fixed side restraints and coupling each of said barrier means to each of said energy absorbing means, respectively, said predetermined restraining force of each of said energy absorbing means being at least as great as an adjacent energy absorbing means, with the least amount of predetermined restraining force being associated with the energy absorbing means coupled to the first of said barrier means which a vehicle comes in contact with, whereby said plurality of barrier means operate in sequence to bring a vehicle to a substantial stop upon engagement by said vehicle with said plurality of barrier means.

23. A restraining barrier system as defined in claim 22 wherein said fixed side restraints are positioned adjacent the base of an inclined roadway, said restraint zone having an entrance portion leading away from said inclined roadway in order to receive runaway vehicles therein.

24. A restraining barrier system as defined in claim 23 wherein said fixed side restraints comprise a series of Jersey-like barriers.

25. A restraining barrier system as defined in claim 22 further including means for indicating the status of said restraining barrier means.

26. A restraining barrier system as defined in claim 25 wherein said status indicating means comprises:

at least one sensing cable means coupling an end of said barrier means to at least one of said first transport means, indicator means for indicating operation of said barrier means for restraining a vehicle, activator means for operating said indicator means, said activator means comprising an element coupled to said sensing cable means such that said activator means is impeded by said sensing cable means from operating said indicator means and said activator means being operated in response to breaking of said sensing cable means in a crash event.

27. A restraining barrier system as defined in claim 22 wherein said restraining barrier means comprises a flexible wall and at least one low wire disposed below and behind the wall, the wall having a height of at least four feet, said low wire distance behind and below the wall being sufficient to assure capture of a low vehicle with a long bumper-forward wheel axis distance while avoiding capture of the wall under forward wheels of a truck or like high vehicle with a low bumper-forward wheel axis distance.

28. A restraining barrier system as defined in claim 27 and further comprising multiple additional wires spanning the wall in its span direction.

29. A restraining barrier system as defined in claim 28 further comprising vertical strips arranged along the net and maintaining the relative spacing of net and wires.

* * * * *